United States Patent [19]

Goff, Jr. et al.

[11] Patent Number: 4,475,829

[45] Date of Patent: Oct. 9, 1984

[54] CAPACITIVE METERING MEANS FOR UNIFORM RIBBON FEED AND TAKE-UP MECHANISM

[75] Inventors: Willie Goff, Jr., Austin; Errol R. Williams, Jr., Round Rock, both of Tex.

[73] Assignee: International Business Machines Corporation, Armonk, N.Y.

[21] Appl. No.: 259,136

[22] Filed: Apr. 30, 1981

[51] Int. Cl.[3] ..... B41J 33/14

[52] U.S. Cl. ..... 400/232; 400/208; 400/225

[58] Field of Search ..... 400/208, 225, 232; 101/93.04, 332, 336; 33/1 PT; 361/298, 299; 242/67.5, 75.5, 75.51, 187; 310/49 R, 68 B; 318/662, 685, 696; 340/347 P, 675, 870, 37; 324/166

[56] References Cited

U.S. PATENT DOCUMENTS

| | | | |
|---|---|---|---|
| 981,808 | 1/1911 | Steele | 400/232 |
| 1,172,733 | 2/1916 | Raber | 242/67.5 |
| 1,669,832 | 5/1928 | Marcalus et al. | 242/67.5 |
| 1,897,903 | 2/1933 | Hopkins | 242/187 |
| 2,168,777 | 8/1939 | McCreary | 242/75.51 X |
| 2,498,234 | 2/1950 | Baker et al. | 242/75.51 |
| 2,580,717 | 1/1952 | Ballou | 242/75.5 X |
| 2,634,064 | 4/1953 | Carroll | 242/67.5 |
| 2,765,989 | 10/1956 | Pell | 242/75.51 |
| 2,991,950 | 7/1961 | Axon et al. | 242/67.5 X |
| 3,115,314 | 12/1963 | Manley et al. | 242/187 |
| 3,137,767 | 6/1964 | Axon et al. | 178/6.6 |
| 3,218,635 | 11/1965 | Masur | 340/347 P X |
| 3,348,650 | 10/1967 | Meinherz et al. | 400/232 X |
| 3,668,672 | 6/1972 | Parnell | 361/298 X |
| 3,702,467 | 11/1972 | Melnyk | 340/347 P X |
| 3,707,910 | 1/1973 | Combs | 101/332 X |
| 3,729,728 | 4/1973 | Hardway, Jr. | 340/870.37 |
| 3,809,327 | 5/1974 | Osman | 242/75.51 |
| 3,889,795 | 6/1975 | Garberi et al. | 400/208 |
| 3,923,141 | 12/1975 | Hengelhaupt | 400/232 X |
| 3,924,177 | 12/1975 | Lemineur et al. | 340/870.37 X |
| 3,938,113 | 2/1976 | Dobson et al. | 340/870.37 |
| 3,954,167 | 5/1976 | Kranz et al. | 400/232 X |
| 3,966,036 | 6/1976 | Bernardis et al. | 400/225 X |
| 4,075,544 | 2/1978 | Leenhouts | 318/696 |
| 4,083,444 | 4/1978 | Salto | 400/208 |
| 4,083,445 | 4/1978 | Brualdi | 400/208 X |
| 4,132,485 | 1/1979 | Hess | 400/208 |
| 4,188,134 | 2/1980 | Garrido | 400/208 |
| 4,322,769 | 3/1982 | Cooper | 361/88 |

OTHER PUBLICATIONS

IBM Technical Disclosure Bulletin, "Reel-to-Reel Tape Unit with Decreased Acceleration Time," Kollar et al., vol. 14, No. 8, Jan. 1972 pp. 2331–2332.

IBM Technical Disclosure Bulletin, "Dual Plane Capacitive Coupling Encoder," Flaherty et al., vol. 15 No. 4, Sep. 1972, pp. 1373–1375.

IBM Technical Disclosure Bulletin, "Electrodynamic Velocity and Position Sensor and Emitter Wheel," Naylor, III, et al. vol. 16, No. 10 Mar. 1974, pp. 3303–3304.

IBM Technical Disclosure Bulletin, "Variable Step--Rate Ribbon Motion," Caville et al., vol. 22, No. 10, Mar. 1980, p. 4359.

*Primary Examiner*—Ernest T. Wright, Jr.

*Attorney, Agent, or Firm*—J. B. Kraft

[57] ABSTRACT

Apparatus for feeding ribbon in an impact printer or typewriter is provided in which the ribbon metering means are very simple and minimize the potential for damage to the ribbon. Ribbon is fed from a supply reel to a take-up reel each of which is adapted to support a portion of an inventory of ribbon running from the supply reel to the take-up reel. The apparatus includes a drive mechanism which drives the take-up reel at a selected one of a plurality of different rotational velocities, apparatus for sensing the portion of the inventory of ribbon on one of the reels and for producing an electrical signal representative of the radius of said portion, and apparatus for selecting one of said rotational velocities in response to said signal. The sensing apparatus used to sense the portion of the ribbon inventory which remains on the supply reel is capacitive sensing apparatus.

6 Claims, 2 Drawing Figures

CAPACITIVE METERING MEANS FOR UNIFORM RIBBON FEED AND TAKE-UP MECHANISM

BACKGROUND OF THE INVENTION

1. Field of the Invention

This invention relates to ribbon feed means in typewriters and impact printers and more particularly to means for metering the ribbon being fed.

2. Description of the Prior Art

In conventional impact printers and typewriters, as the printing proceeds, the inventory of ribbon is moved from a portion on a supply spool to a take-up spool which winds up the ribbon after it is printed upon. In order to obtain a uniform ribbon feed, it has been traditional to provide means for metering the ribbon which is separate from the means for driving the take-up reel which winds the used ribbon. Such conventional ribbon metering means are extensively shown in the prior art. For example, U.S. Pat. No. 3,348,650, J. Meinherz et al, filed July 3, 1962 discloses such a ribbon metering apparatus wherein ribbon from a supply reel is metered so as to move at a uniform rate to a take-up reel (not shown). In such an apparatus, it would be conventional to have a separate drive mechanism for the take-up reel.

while such ribbon metering apparatus served the impact printer and typewriter technology very well for several generations and still continues to be significant, we have found that there is a potential for problems in this conventional approach. With the direction in the typewriter and printer art towards thinner and more fragile ribbons, tolerances within which these ribbons can withstand damage become much more limited. Consequently, where separate metering elements are used in printers, there appears to be an increasing possibility that the coordination of the operation of ribbon metering with the standard ribbon take-up drive may cause problems with respect to ribbon movement and stresses on the ribbon beyond the limited tolerances of such fragile ribbons.

Consequently, there is a need in the riboon feed technology for apparatus which eliminates separate ribbon metering and integrates the ribbon metering function into the ribbon take-up drive mechanism. Such apparatus will, in addition to minimizing the effects of ribbon feed which could damage fragile ribbons, also substantially reduce ribbon feed cost by eliminating such separate ribbon metering apparatus.

U.S. Pat. No. 3,923,141, Hengelhaupt, filed July 1, 1974, represents an approach taken in the art to eliminate separate ribbon metering drives. In the apparatus of this patent, the ribbon metering function is integrated with the ribbon take-up roller. The ribbon is metered at a uniform or constant rate by mechanical means which sense the radius of the ribbon portion on the take-up spool, and through a series of rather complex mechanical linkages constantly vary the velocity of the peripheral take-up reel drive roller with changes in radius of the ribbon portion on the take-up reel so that the ribbon moves at a uniform rate. While such apparatus does eliminate separate ribbon metering mechanism, its complex mechanical linkages would appear to have a greater possibility for ribbon metering and drive irregularities which could potentially damage the relatively fragile ribbons currently in extensive usage.

SUMMARY OF THE PRESENT INVENTION

The present invention provides a ribbon feed apparatus which eliminates separate ribbon metering. In addition, apparatus of the present invention further eliminates the complex mechanical linkages of the prior art structures wherein ribbon metering and ribbon drive mechanisms are integrated in a single structure. The present invention accomplishes this by efficient low cost apparatus.

The apparatus includes the conventional take-up and supply reels each adapted to support a portion of inventory of ribbon running from the supply reel to the take-up reel. The apparatus further includes means for driving the take-up reel drive at a selected one of a plurality of different rotational velocities. Means are provided for sensing the portion of inventory of ribbon on one of the reels, preferably the supply reel and for producing an electrical signal representation of the radius of said portion. In addition, means are provided responsive to said signal for selecting one of said rotational velocities for the ribbon take-up reel whereby ribbon is taken up and moves at a relatively uniform overall rate irrespective of the relative portions of the inventory of ribbon on each of the two reels.

For best results the inventory of ribbon on the supply reel is unused ribbon and the sensing means senses this unused ribbon so that the sensing is unimpeded by variations in the thickness of the ribbon on the reel which may be caused by usage.

In accordance with a more particular aspect of the present invention, the sensing means include a follower member tensioned against the periphery of the portion of the ribbon inventory on the supply reel so as to maintain a tautness on the ribbon running from the supply reel to the take-up reel. In addition, the sensing means include a capacitive transducer to sense the movement of this follower with respect to the axis of the supply reel to thereby provide an indication of the radius of inventory of ribbon on the supply reel.

DETAILED DESCRIPTION OF THE PREFERRED EMBODIMENT

Figure 1:
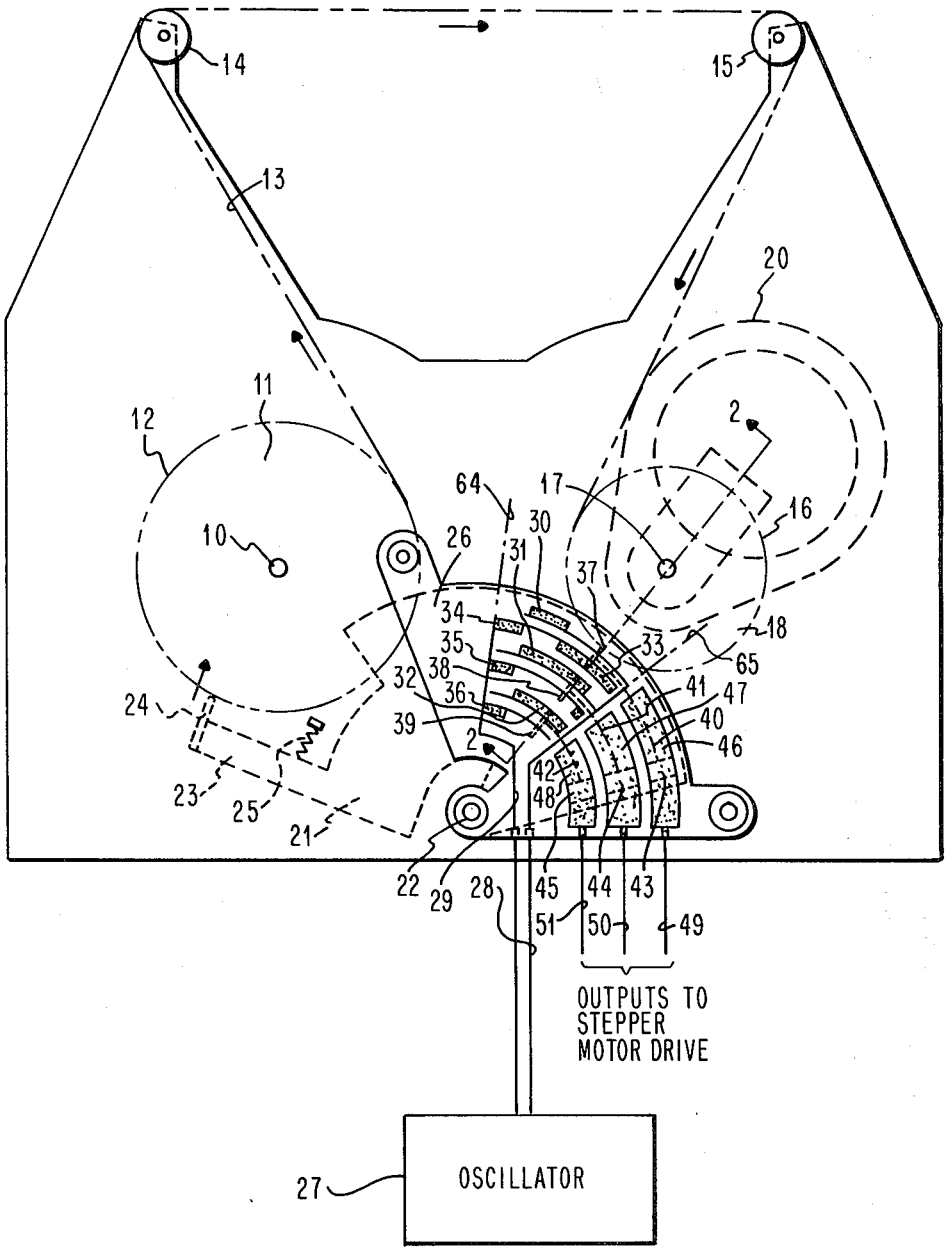
FIG. 1 is a diagrammatic plan view of the ribbon feed and take-up mechanism of the present invention illustrating capacitive sensing means for sensing the portion of the ribbon inventory on the supply reel.

With reference to FIG. 1 rotationally mounted ribbon supply reel hub 10 has mounted thereon a portion 11 of an inventory of printer ribbon 13 which runs from the supply reel 12 along a path over rollers 14 and 15 to take-up reel 16 having a hub 17 on which the portion of taken up ribbon inventory 18 is mounted. It will be understood by those skilled in the art that this ribbon supply and take-up mechanism, which has been shown in generalized diagrammatic form, may be any conventional ribbon take-up and supply mechanism such as ribbon mounted in a cartridge or directly on a printer.

Figure 2:
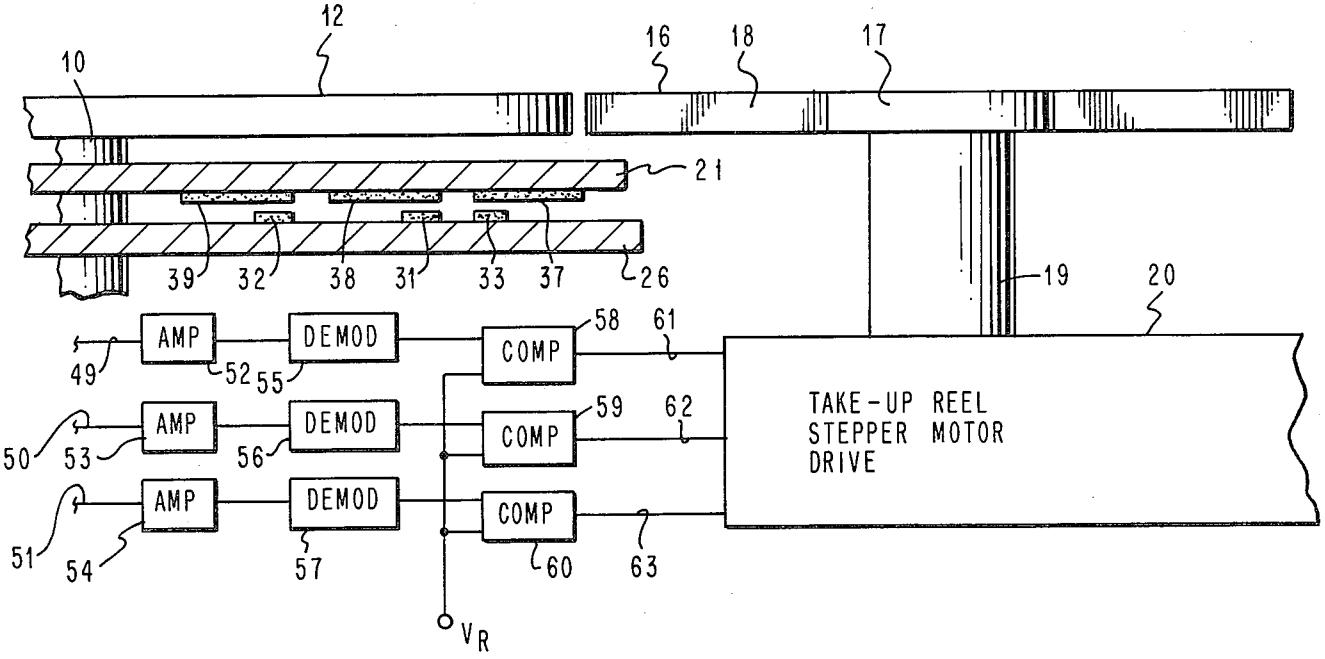
FIG. 2 is a partial sectional view along line 2—2 of FIG. 1, particularly illustrating a portion of the capacitive sensor as well as the take-up reel and its drive.

Ribbon supply reel hub 10 is mounted so as to be freely rotatable while take-up reel hub 17, as shown in FIG. 2, fixed to a drive shaft 19 which is driven by a stepper motor drive 20 will be further described hereinafter. Stepper motor drive 20 may be any conventional stepper motor which has the capability of operating at a plurality of different rates, i.e., a different number of steps for fixed time increment or cycle. Variable speed or rate stepper motor drives are well known in the art, and any conventional variable speed stepper motor may be used. Typical prior art variable speed stepper motors are described in the text, *Theory and Applications of Step Motors,* Benjamin C. Kuo, West Publishing Company, St. Paul, 1974 and particularly in Chapter 10, pages 206–251. As will be hereinafter described, means are provided for sensing the portion of ribbon portion 11 on supply reel 12, i.e., the radius of ribbon portion 11, and in response to this sensed radius to vary the stepper motor drive rate whereby ribbon 13 moving from the supply reel 12 to the take-up reel 16 along a path indicated by the arrows always moves at a near uniform rate irrespective of the radius of ribbon portion 11. Thus, when the radius of ribbon portion 11 is relatively small and the radius of inventory portion 18 on the take-up reel 16 is relatively large, the stepper motor rate should be relatively small. On the other hand, where the inventory of ribbon portion 11 on supply reel 12 is relatively large, and consequently the inventory portion 18 on the take-up reel 16 relatively small, the stepper motor drive 20 should be stepped at a higher rate in order to maintain a near uniform speed of ribbon 13.

This is accomplished by sensing the radius of ribbon portion 11 and providing an input to stepper motor drive 20 representative of this sensed radius, in response to which the stepper motor drive 20 varies the stepper motor rate based upon predetermined rates selected according to the principle set forth above. The means for sensing the inventory of ribbon portion 11 on supply reel 12 may be any conventional sensing means such as mechanical or optical means. However, for best results, carrying out the present invention, I have utilized a capacitive sensing means which I will describe hereinafter.

With reference to FIG. 1, the capacitive sensing means comprise a rotor 21 rotatably mounted on shaft 22 having a leg 23 with a foot 24 contacting the periphery of ribbon portion 11 on supply reel 12. Leg 23 is spring loaded by spring means 25 so that rotor 21 rotates clockwise about shaft 22 whereby foot 24 is urged in the clockwise direction shown by the arrow as the radius of the ribbon portion 11 diminishes. Thus, tensioned foot 24 and leg 23 serve a function in addition to the sensing of the radius of ribbon portion 11. Foot 24 provides a tension on the periphery of ribbon portion 11 whereby the ribbon 13 along the path shown by the arrows is maintained in a taunt condition as it is driven by take-up reel 16. Rotor 21 coacts with a stationary stator 26 to provide capacitive positional sensing. Stator 26 has the fixed position shown, and rotor 21 moves relative to it. The relationship of rotor 21 and stator 26 may be better understood with reference to the sectional view of FIG. 2. Rotor 21 is positioned above stator 26. However, for purposes of illustration so that the relationship of rotor 21 with respect to stator 26 is more clearly understood as the movement of rotor 21 is described, rotor 21 has been shown in fully dotted lines in FIG. 1. In effect, the combination of rotor 21 and stator 26 provide a capacitive transducer designed to provide a specific output indicative of the radius of ribbon portion 11 on supply reel 12. The concepts of capacitive transducers used in the present sensing device may be found extensively in the prior art. For example in the following:

"Dual Plane Capacitive Coupling Encoder", authored by R. J. Flaherty, M. L. Sendelweck, and J. W. Woods, *IBM Technical Disclosure Bulletin,* Vol. 15, No. 4, Sept. 1972, p. 1373.

"Electrodynamic Velocity and Position Sensor and Emitter Wheel", authored by H. E. Naylor, III, and R. A. Williams, *IBM Technical Disclosure Bulletin,* Vol. 16, No. 10, March 1974, p. 3303.

U.S. Pat. No. 3,702,467, "Shaft Position Sensing Device", George Melnyk, Issued Nov. 7, 1972.

U.S. Pat. No. 3,938,113, "Differential Capacitive Position Encoder", D. R. Dobson et al, Issued Feb. 10, 1976.

This stator 26 comprises an oscillator 27 which produces an oscillating input along lines 28 and 29 to conductive plates 30–36 on the stator 26. The conductive plates 30, 31, and 32 on the stator 26 are connected to line 28; another plurality of conductive plates 33, 34, 35 and 36 are connected to line 29. The rotor 21 comprises a plurality of conductive plates 37, 38 and 39 which are spaced from the stator 26 but are capacitively coupled with the stator 26 when they are in a position above the stator 26. The relationship of rotor plates 37, 38 and 39 with respect to conductive plates 30, 31 and 32 may be better understood with reference to the sectional view in FIG. 2.

During a take-up cycle wherein a full ribbon portion 11 is taken up until the end of the ribbon inventory on supply reel 12 is reached, rotor conductive plates 37, 38 and 39 will move from an initial position indicated by phantom line 64 with a full ribbon supply portion 11 to a position indicated by phantom line 65 when the end of the supply is reached.

During this movement, rotor conductive plates 37, 38 and 39 will be in a combination of positions with respect to stator conductive plates 30–36. Since line 28 and 29 to the stator 26 from oscillator 27 will be at opposite voltage levels, stator conductive plates 30, 31 and 32 will be at opposite voltage levels from stator conductive plates 33–36. Consequently, the capacitive effect produced respectively by each of rotor conductive plates 37, 38 and 39 with a stator conductive plate 30–36 will depend on the combination of rotor conductive plates 37, 38 and 39 and stator conductive plates 30–36 coupled with each other which in turn will depend on the position of rotor conductive plates 37, 38 and 39. The outputs on rotor conductive plates 37, 38 and 39 in response to the oscillator input appear respectively on lines 40, 41 and 42 from these rotor conductive plates 37, 38 and 39 which are in turn respectively connected to conductive pads 43, 44 and 45 in turn coupled to conductive pads 46, 47 and 48 on the stator 26 to provide respective outputs on lines 49, 50 and 51. It should be noted that the coupling between rotor conductive pads 43, 44 and 45 respectively with stator conductive pads 46, 47 and 48 may be in direct contact. However, since conductive pads 43–45 are on the rotating rotor 21, contacts between the two sets of conductive pads, 43–45, 46–48 may be capacitive. With such capacitive coupling, the respective areas of conductive pads 46, 47 and 48 and conductive pads 43, 44 and 45 are substantial, they are in affect almost a direct conductive coupling.

The outputs on lines 49, 50 and 51 (FIG. 2) are respectively amplified through amplifiers 52, 53 and 54 and then demodulated through demodulators 55, 56 and 57. The output of these demodulators 55, 56 and 57 are respectively applied to comparators 58, 59 and 60 which in turn produce a binary output on each of lines 61, 62 and 63 to the stepper motor drive 20. It should be noted that the capacitive transducer circuitry described above is well known in the art as set forth above as well as in copending patent application "A Capacitive Transducer for Sensing a Home Position", D. R. Polk et al, filed Dec. 22, 1980, Ser. No. 219,081.

Based upon the combined binary input on lines 61, 62 and 63, the stepper motor drive circuitry may select one of several possible stepper motor rates. The binary outputs on lines 61, 62 and 63 will of course be representative of the relative position of rotor 21 and consequently the radius of ribbon portion 11 on supply reel 12. Consequently, the preselected stepper motor rates per fixed time increment will vary accordingly. For example, the following is a chart illustrating the number of stepper motor steps per time increment for various combinations of binary values on input lines 61, 62 and 63.

| Line 63 | Line 62 | Line 61 | Motor Steps per Time Increment |
|---|---|---|---|
| 0 | 0 | 0 | 7 |
| 0 | 0 | 1 | 6 |
| 0 | 1 | 1 | 5 |
| 1 | 1 | 1 | 4 |
| 1 | 1 | 0 | 3 |
| 1 | 0 | 0 | End of ribbon portion 11 signal |

While the invention has been particularly shown and described with reference to a preferred embodiment it will be understood by those skilled in the art that various other changes in form and detail may be made without departing from the spirit and scope of the invention.

What is claimed is:

1. Apparatus for feeding ribbon from a supply reel to a take-up reel, each reel supporting a portion of a fixed inventory of ribbon running from the supply reel to the take-up reel comprising means for driving said take-up reel at selected one of a plurality of different rotational velocities, capacitive means for sensing the portion of said inventory of ribbon on said supply reel and for producing an electrical signal representative of the radius of said portion, and means for selecting one of said rotational velocities in response to said signal.

2. The apparatus of claim 1 wherein the portion of said inventory on said supply reel is unused ribbon.

3. The apparatus of claim 1 wherein said capacitive sensing means include a follower member tensioned against the periphery of the portion of said ribbon inventory on said supply reel so as to maintain a tautness on the ribbon running from the supply reel to the take-up reel.

4. The apparatus of claim 3 wherein said capacitive sensing means include a capacitive transducer for sensing the movement of said follower member with respect to the axis of said supply reel to thereby provide an indication of the radius of said inventory of ribbon on said supply reel.

5. The apparatus of claim 4 wherein said capacitive transducer comprises first and second spaced pluralities of elements, means for applying an alternating electrical signal to one of said plurality of elements, and means connected to the second plurality of elements for sensing the capacitive effect induced in said second plurality of elements by said alternating electrical signal, said first and second plurality of elements being arranged so that relative motion between the two pluralities of elements varies the capacitive effect produced, and one of said pluralities of elements is connected to said follower member whereby the movement of said follower member produces a concurrent relative motion between said two pluralities of elements.

6. The apparatus of claim 5 wherein the plurality of elements connected to said follower member is moved in direct relationship to changes in ribbon inventory on the supply reel while the other plurality of elements remains stationary.

* * * * *